US005698827A

United States Patent [19]

Turjancik

[11] Patent Number: 5,698,827

[45] Date of Patent: Dec. 16, 1997

[54] MICRO- TO MACROMOTION SENSING, DETECTING AND WARNING DEVICE

[76] Inventor: Vasil W. Turjancik, 234 Ackerman Ave., Clifton, N.J. 07011

[21] Appl. No.: 691,596

[22] Filed: Aug. 2, 1996

[51] Int. Cl.[6] ..... H01H 35/02; G08B 13/02; G08B 21/00

[52] U.S. Cl. ..... 200/61.45 R; 200/61.52; 200/DIG. 29; 340/686; 340/689; 338/13

[58] Field of Search ..... 338/13; 200/61.54, 200/61.48, 61.49, 61.45 R, 61.53, 61.52, DIG. 29; 340/467, 464, 686, 566, 689, 693; 307/121

[56] References Cited

U.S. PATENT DOCUMENTS

| | | | |
|---|---|---|---|
| 4,124,841 | 11/1978 | Kettunen | 340/690 |
| 4,196,429 | 4/1980 | Davis | 340/669 |
| 4,365,421 | 12/1982 | Byrum | 33/366 |
| 4,497,118 | 2/1985 | Byrum | 33/366 |
| 4,833,281 | 5/1989 | Maples | 200/61.45 R |
| 4,980,575 | 12/1990 | Schenkel | 307/121 |
| 5,034,579 | 7/1991 | Rowland | 200/61.45 R |
| 5,136,127 | 8/1992 | Blair | 200/61.52 |
| 5,153,566 | 10/1992 | Yun | 340/689 |
| 5,155,308 | 10/1992 | Blair | 200/61.52 |
| 5,307,054 | 4/1994 | Concannon, Sr. | 340/686 |
| 5,309,141 | 5/1994 | Mason et al. | 340/467 |
| 5,319,350 | 6/1994 | Demarco et al. | 340/435 |
| 5,321,390 | 6/1994 | Yuen | 340/566 |
| 5,335,941 | 8/1994 | Fohn | 200/206 |
| 5,393,944 | 2/1995 | Manandhar et al. | 200/61.45 R |
| 5,627,316 | 5/1997 | De Winter et al. | 73/514.32 |

OTHER PUBLICATIONS

Caristi, A.J. (1995) Popular Electronics, May, pp. 46–50.
Grable, R. (1994) Autotronics, Apr., pp. 70–74.
Janis. R. (1995) Autortronics, Apr., pp. 19–24.
Janis, R. (1994?) "Sensing Trouble", Autotronics, 2 pages.
Janis, R. (1995) Autotronics, Jan., pp. 69–74.
(1995) Electronics, Now, Feb., pp. 36–41.

*Primary Examiner*—Adolf Berhane
*Attorney, Agent, or Firm*—Klauber & Jackson

[57] ABSTRACT

A device capable of detecting motion, especially extremely small amounts of motion (micromotion) which has three portions: (a) a sensing portion, (b) a detecting portion, and (c) a warning portion: (A) the sensing portion has (1) a micro- to macromotion pathway having a conformation which permits repeated, reciprocal movement from or about a gravitational resting point, of a ball which is in constant contact with it and which is free to move on it in response to external forces; (2) a terminal domain whose conformation requires the ball to be in constant contact with it when the ball is at the gravitational resting point on the pathway, but which also permits the ball to move away from it in response to external forces; both the pathway and the terminal domain being made of a material whose electrical resistance is between 0.8 and 10 times that of copper, where the resistance of copper is given as 1.0; and (3) a ball disposed for repeated, reciprocal movement from or about the gravitational resting point on the pathway and in constant contact with it, the ball being made of a material whose electrical resistance is at least 1000 times that of copper, where the resistance of copper is given as 1.0; (B) the detecting portion has detection circuitry associated with the sensing portion which detects fluctuations in electrical current passing through the sensing portion, and which activates the warning portion of the device when a predetermined change in the electrical current takes place; and (C) the warning portion, which alerts a user of the device, another person, or both, that a micro- to macromotion has been sensed and detected.

20 Claims, 2 Drawing Sheets

MICRO- TO MACROMOTION SENSING, DETECTING AND WARNING DEVICE

FIELD OF THE INVENTION

The present invention is in the field of devices capable of detecting motion, especially extremely small amounts of motion which are referred to herein as micromotion. Such devices are typically provided with an electrical/electronic portion which is capable of detecting the motion and translating it into an audible or visible signal to the user of the device. It is common for such devices to utilize as the motion sensor an electrically conductive ball that travels about a predetermined path in response to such motion, in the course of which it makes and breaks electrical contact with various terminals along the way. Such devices are frequently incorporated into anti-theft and related security devices for automobiles and other possessions, as a critical part thereof.

BACKGROUND OF THE INVENTION

The field of the invention already has within its known art, disclosures of a number of devices as described below in more detail. Such devices, however, are also known to suffer from a number of disadvantages. For example, in the types of motion sensors that employ an electrically conductive ball, reliance is usually placed on the ball making and breaking electrical contact in order to activate the alarm portion of the device. Such making and breaking of electrical contact requires a certain minimum quantity of motion, and arcing at the point of electrical contact also poses problems of damage and deterioration to the parts of the device involved, including the electrically conductive ball. Consequently, there is an ongoing need in the art for improved motion sensor devices, and especially those which provide an increased sensitivity to small amounts of motion, or micromotion.

The motion sensing and detecting devices of the present invention are useful, as are those devices already known in the art, in a number of applications. The primary market for such motion sensing devices is in making anti-theft contrivances for personal possessions of significant value which are also easily moved or portable, e.g., automobiles, sporting vehicles for travel on snow, water and land, and sporting goods such as golfing and skiing equipment. However, there are a multitude of uses to which motion sensors and detectors can be put. For example, motion sensors have been incorporated into various portable, battery-powered electrical devices and used to maintain the battery in a mode disconnected from the load circuitry of the device during periods in which the device is immobile, but to reconnect the battery and load circuitry when the device is moved. One particular form of such a device is the transmitter/beacon devices activated by a push-button which motorists use to provide totally passive keyless entry systems for their automobiles in order to prevent the drain on the internal power source for the transmitter which would otherwise take place. The device is operational only when motion is detected by the motion sensor, e.g., when the motorist is walking toward the automobile. Satisfactory performance of such motion detectors requires detection of extremely low levels of acceleration in all orientations, reliability, simplicity of structure and ease of assembly, a minimum number of pans, and low cost.

Another use to which motion sensing devices have been put heretofore is in making emergency deceleration warning devices that warn others that a vehicle equipped with the device is decelerating at an abnormal rate and may accordingly pose a danger. Security devices for the home may also employ motion sensors as pan of the array of detectors which can be activated by an intruder. Where a high degree of security is required, e.g., in the intelligence, military and scientific operations of government agencies involving highly sensitive matter, there is a need for motion sensors and detectors of extremely small amounts of motion, or micromotion. Such sensors and detectors would also find useful applications in various scientific, engineering and industrial settings where the capacities of such micromotion sensors would prove advantageous, e.g., in studies of seismic activity.

BRIEF DESCRIPTION OF THE PRIOR ART

U.S. Pat. No. 4,833,281 to Maples discloses a motion detector comprising a spool surrounded by and electrically insulated from a shell, with a ball positioned in the annular cavity around the spool. Motion is detected when the ball moves into and out of direct contact with the spool or shell acting as the poles of a switch, with the ball acting to close or open the switch. It is also provided that when the ball is supported by both the spool and shell, that imperfections of the interface surfaces either from machining or from intentionally added surface roughness during manufacture, coupled with the movement of the ball, will momentarily open and close the switch. It is specified that the electronics must detect a change in state, i.e., open to short, or short to open condition as an indication of motion. However, with the device of the present invention, is always closing the electrical circuit, and such artificial treatment of the ball is not required, despite which a more sensitive motion sensor is obtained.

U.S. Pat. No. 4,980,575 to Schenkel discloses a motion detector comprising first and second housings of electrically conductive material separated by a joinder member of electrically insulating material, which also defines a central passage between the two housings permitting movement therebetween of two metal spheres disposed in said housings. These elements are dimensioned such that movement of the device will bring the metal spheres into contact with each other and establish electrical continuity between the housings and their corresponding circuitry. Unlike the present invention, however, operation of the patented device relies on significant movement of the metal spheres into and out of contact with the housings.

U.S. Pat. No. 5,034,579 to Rowland discloses a motion detector which features in particular means for preventing the ball from moving in its ball race when the device is not in use, thereby preventing unnecessary wear of the electrical contacts involved. The ball race is formed by a conical member and the annular surface of a disc member, around the peripheral portion of which is a printed circuit board with an endless array of electrical contacts. In the operational mode, the ball forms an electrically conductive bridge between the conical member and the contact array of the disc member. In the inoperative mode, the disc member is displaced toward the conical member by actuating a lock, and this action displaces the ball radially inwardly into an inoperative condition in which it is no longer touching the contact array of the disc member. When the ball is simultaneously moving on the electrically conductive conical member as well as around the annular array of contacts, it is successively and repeatedly making and breaking an electrical connection between those parts of the device. The sensitivity of the device thus depends on the lateral spacings and design of the conductor strips on the array, as well as their height or thickness. Thus, the patented device is similar in operation to those devices of the prior art described further above, and is not able to achieve, it is believed, the high degree of sensitivity achieved with the novel operational features of the device of the present invention.

U.S. Pat. No. 5,153,566 to Yun discloses a motion sensor in which the ball track is formed by an array of printed circuit, interdigitated zig-zag shaped conductors on a flat surface over which a housing of an electrically insulating material is mounted to form a cylindrical/conical section chamber in which the ball moves. The diameter of the ball is larger than the interdigital spacing and the movement of the ball thus opens and breaks electrical circuits in succession. The zig-zag pattern assures that even simple radial movement of the ball will result in interruption of the circuit. An associated integrated circuit detects any transition in electrical voltage resulting from the circuit interruption occurring in the device. As with other devices of this type in the prior art, however, sensitivity is dependent on the specifications of the printed circuit board and represents an additional cost as well.

U.S. Pat. No. 5,307,054 to Concannon et al. discloses a motion sensor especially adapted for use as a detector of seismic activity. A preferred configuration comprises a contact dish assembly which is a woven screen slightly concave upwardly and electrically connected to a supporting ring, on which a conductive contact ball rests. Movement, e.g., from an earthquake causes the ball to roll about on the screen, and with sufficient amplitude and duration of seismic activity, the ball will another ring, forming a conductive path between said ring, the screen, the supporting ring, and the remainder of the device circuitry. Here again, unlike the present invention, reliance is placed on the movement of the conductive ball to make and break electrical contact.

U.S. Pat. No. 5,309,141 to Mason et al. discloses an emergency deceleration warning device in which one embodiment of the motion sensor involved utilizes a ball moving on an inclined track to make and break electrical contact.

U.S. Pat. No. 5,335,941 to Föhl discloses a vehicle deceleration sensor for activating a restraining system in which an inertial mass ball is movably accommodated in a housing and in contact with a first spring. Movement of the ball in response to ,notion brings it into contact with a second spring. The movement of the ball is also dampened by a spring blade in frictional engagement with the ball.

U.S. Pat. No. 5,393,944 discloses a deceleration switch in which a mass supported on and pivotable about a continuous piece of plastic molded material having a resilient central portion which acts as a hinge, is moved by deceleration into an actuated position, causing electrical terminals to move into engagement with each other and electrically close a switch.

Further aspects and uses, as well as additional advantages of the present invention will become apparent to those of ordinary skill in the art to which this invention relates from the detailed description of the present invention which follows, including preferred embodiments thereof, and the appended claims, taken in conjunction with the accompanying drawings.

SUMMARY OF THE INVENTION

Figure 1:
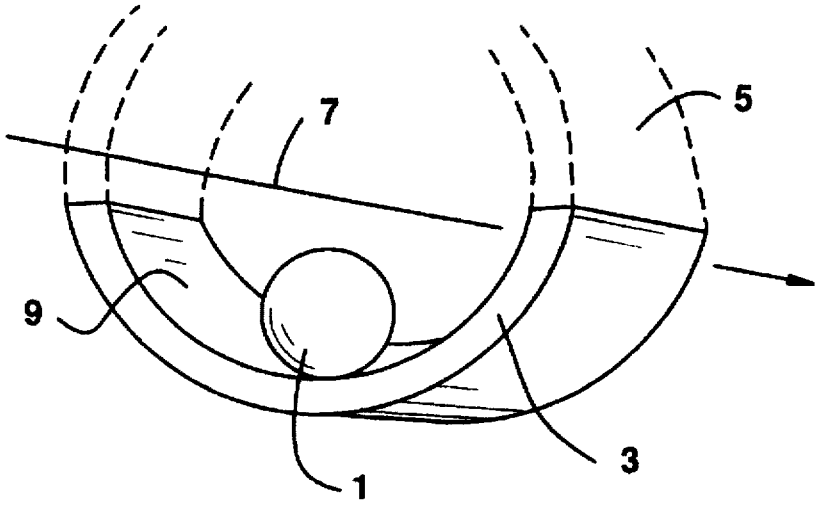
FIG. 1 is an oblique elevational view of a micro- to macromotion pathway having a flat conformation and a substantially spherical object associated therewith, as used in the devices of the present invention.

In accordance with the present invention there is provided a micro- to macromotion sensing, detecting and warning device comprising three portions: (a) a sensing portion, (b) a detecting portion, and (c) a warning portion.

(A) The micro- to macromotion sensing portion of the device comprises the following components: (1) a micro- to macromotion pathway having a conformation which permits repeated, reciprocal movement from or about a gravitational resting point thereon of a substantially spherical object in constant contact therewith and free to move thereon in response to external forces, a portion of said pathway which is in contact with said spherical object being made of a material whose electrical resistance is between 0.8 and 10 times that of copper, where the resistance of copper is given as 1.0; (2) a terminal domain having a conformation which requires the substantially spherical object to be in constant contact therewith when at the gravitational resting point on said pathway, but which also permits the substantially spherical object to move away therefrom in response to external forces, a portion of said terminal domain which is in contact with said spherical object being made of a material whose electrical resistance is between 0.8 and 10 times that of copper, where the resistance of copper is given as 1.0; and (3) a substantially spherical object disposed for repeated, reciprocal movement from or about said gravitational resting point on said micro- to macromotion pathway and in constant contact therewith, the portion of said spherical object being in contact with said pathway being made of a material whose electrical resistance is at least 1000 times that of copper, where the resistance of copper is given as 1.0.

(B) The detecting portion of the device for determining the presence of micro- to macromotion comprises the following components: (1) a source of direct current electromotive force of about 12 volts or less, being substantially negative (−) with a positive (+) component of from about 1% to about 3% thereof; (2) the substantially spherical object is in electrical contact with the negative terminal of the source of direct current, the terminal being the ground reference in the system, by way of the terminal domain or by way of the micro- to macromotion pathway, such that when the substantially spherical object is at the gravitational resting point of the micro- to macromotion pathway, it is simultaneously in electrical contact with the pathway and with the terminal domain; (3) the micro- to macromotion pathway or the terminal domain is in electrical contact with detection circuitry as defined herein, when the other is in electrical contact with the negative terminal of the source of direct current, thereby forming a complete electrical circuit through the substantially spherical object when at the gravitational resting point of the pathway; and (4) detection circuitry associated with the micro- to macromotion sensing portion which detects fluctuations in electrical current passing through the sensing portion, and which activates a warning portion of the device as defined herein when a predetermined change in the electrical current takes place.

(C) The warning portion of the device for alerting a user of the device, another person, or both, that a micro- to macromotion has been sensed and detected, comprises the following components: means for translating electrical current from the detecting portion into a signal which provides useful information to the user, another person, or both.

In accordance with the present invention there is further provided a micro- to macromotion sensing, detecting, and warning device wherein the conformation of the micro- to macromotion pathway is substantially flat with respect to constant contact travel of the spherical object thereon, and comprises approximately half of a transverse section of a cylinder cut parallel to the axis thereof, with the spherical object traveling perpendicular to the axis. The conformation of the micro- to macromotion pathway may also be substantially curved with respect to constant contact travel of the spherical object thereon, and may comprise approximately half of a transverse section of a cylinder cut parallel to the axis thereof, with the spherical object traveling parallel to the axis, and the pathway being maintained at an angle to the plane of the earth's surface.

Further in accordance with the present invention there is provided a device as described above wherein the material from which the portion of the pathway being in contact with the spherical object is made is copper, brass or aluminum, and wherein the repeated, reciprocal movement of the substantially spherical object in constant contact with the pathway measures a total length of less than 10μ. There is still further included a device as described above wherein the material from which the portion of the spherical object in contact with the pathway is made is chromium or an alloy of chromium, especially where the alloy of chromium is nickel chromium, and more especially where the nickel chromium alloy is a coating on a core of steel.

Still further in accordance with the present invention there is provided a device as described above wherein the source of direct current electromotive force is about 12 volts, being from about 11.5 to 11.9 volts negative (−) and about 0.5 to 0.1 volts positive (+), and wherein the substantially spherical object is connected to ground by electrical contact directly through the micro- to macromotion pathway by means of a portion of the detection circuitry attached to said pathway, or wherein the substantially spherical object is connected to ground by electrical contact with the terminal domain, which is a section of copper wire laterally disposed toward the spherical object.

In accordance with the present invention, the detection circuitry associated with the micro- to macromotion sensing portion which detects fluctuations in electrical current passing through the sensing portion, comprises an initial resistor of from about 0.5K to 5K Ω, followed by a divided circuit comprising a bleeding resistor having a resistance of from about 100K to 1MM Ω in one branch of the divided circuit and a capacitor having a capacitance of from about 0.005 to 0.2 μF (microFarad) in the other branch of the divided circuit, the divided circuit being rejoined and followed by a resistor of from about 0.5K to 5K Ω and a transistor that when activated will provide sufficient current to operate the warning portion of the device.

Further in accordance with the present invention there is provided a device as described above wherein the signal which provides useful information to the user, another person, or both, is a signal which is audible or visible, or both, to the user of the device, another person, or both, or which is an electronic signal for inputing data to a computer or other electronic device.

DETAILED DESCRIPTION OF THE INVENTION

The device of the present invention is for detecting motion all the way from extremely small amounts of motion, i.e., micromotion, to fairly significant amounts of motion, i.e., macromotion, which thus indicates both the range and the sensitivity of the device. The sensitivity of the device of the present invention is so high that it is capable of measuring a microshock, which is included within the meaning of the term "micromotion" as used herein. The term "microshock" is used to mean extremely small disturbances of the physical environment which might not be perceived or characterized as motion on the part of the device or some object to which the device is attached or with which it is associated. The term "micromotion" simply refers to extremely small amounts of motion, while the term "macromotion" refers to substantial amounts of motion that would be readily perceived. The device of the present invention is able to detect both types of motion and all degrees of motion in between, and thus these terms are used as an indication of the high degree of sensitivity and range afforded by the device, and are not intended to be a limitation on either aspect of the detection of which the device is capable. Thus, it is a unique feature of the device of the present invention that it is able to accurately detect microshocks or micromotion on the one hand, while still being able to reliably detect much grosser shocks and degrees of motion on the other hand.

For convenience of description and recitation, the device of the present invention has been divided into three portions: a sensing portion, a detecting portion, and a warning portion. The first component of the micro- to macromotion sensing portion of the device comprises a micro- to macromotion pathway having a conformation which permits repeated, reciprocal movement from or about a gravitational resting point thereon of a substantially spherical object in constant contact therewith and free to move thereon in response to external forces. The pathway is the area which accommodates the movement of the substantially spherical object, which in the preferred embodiments of the devices herein is usually a nickel chromium (nichrome) plated steel ball of suitable dimensions. The dimensions of the pathway are selected to accommodate the ball and also provide a travel area, since the ball is in constant contact with the pathway.

It is an important feature of the device of the present invention that the pathway configuration be such that the ball will come to rest, after being set in motion, in its original, starting position. This position is referred to as the "gravitational resting point", since the force that moves the ball to that point and holds it there is the force of gravity. However, the ball is also free to move along the micro- to macromotion pathway in response to external forces, which is the underlying mechanism by which the device of the present invention works. The movement of the ball is recited herein as being "from or about" the gravitational resting point. If the gravitational resting point is "A", and the point at which the ball has moved furthest away from the gravitational resting point before starting its return, is "B", then the "from" movement would be described by:

"A—B—A"

while the "about" movement would be described by:

"A—B—A—$B^1$—A—$B^2$—A—$B^3$ . . ."

with each successive "$B^x$" being shorter in distance than its predecessor, since the ball is oscillating about the gravitational resting point, and under the influence of gravity will eventually come to rest.

One of the preferred configurations for the pathway is for it to be substantially flat with respect to the constant contact area of travel of the ball, and to be approximately half of a transverse section of a cylinder cut parallel to its axis. This might also be described as one-half of a circular band whose width is about twice that of the ball. The ball travels perpendicular to the cylinder axis, which might also be described as moving about the inside circumference of the circular band. The pathway is positioned so that the ball will come to rest in the bottom thereof. These features of the pathway are shown in FIG. 1 where the ball 1 lies at the bottom of the pathway 3, which can be seen to be approximately half of a transverse section of a cylinder, the complete pan of which is suggested at 5, cut parallel to its axis 7. The pathway is substantially flat, e.g., as shown at 9, with respect to the travel of ball 1.

Figure 2:
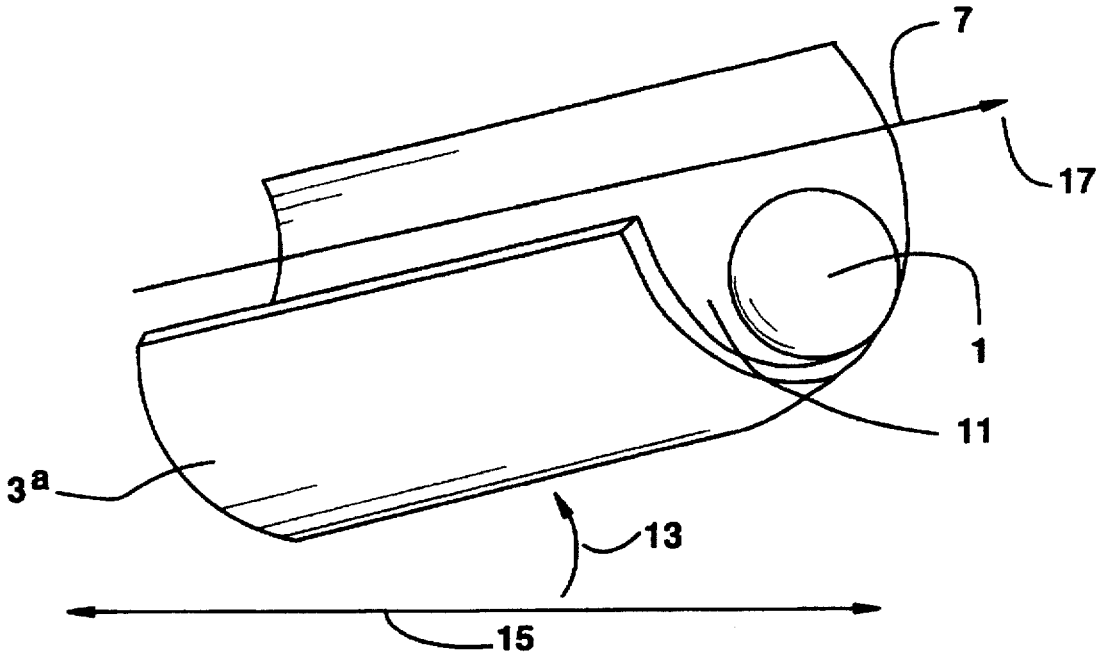
FIG. 2 is an oblique elevational view of a micro- to macromotion pathway having a curved conformation and a substantially spherical object associated therewith, as used in the devices of the present invention.

Another preferred embodiment for the configuration of the micro- to macromotion pathway is shown in FIG. 2 where the conformation of micro- to macromotion pathway $3^a$ is substantially curved, as shown at 11, with respect to the path of constant contact travel of ball 1, and comprises approximately half of a transverse section of a cylinder cut parallel to the axis 7 thereof, with ball 1 traveling parallel to axis 7. Pathway $3^a$ is maintained at an angle 13 to the plane of the earth's surface, shown as 15. Ball 1 is shown at the top of pathway $3^a$, where it would be moved by a substantial macromotion. When at rest, it would be at the bottom of pathway $3^a$, lodged against an electrically insulating stop (not shown). This particular pathway conformation is especially well suited for use of the micro- to macromotion sensing device of the present invention in constructing a deceleration warning device for an automobile, where the line of travel of the automobile is essentially parallel to axis 7 and in the same direction, as shown by axis arrow 17. The motion of the automobile will have imparted to ball 1 the velocity at which it is traveling, and this inertia will tend to keep ball 1 moving in direction 17 at the same velocity, even when the velocity of the automobile is suddenly reduced. The resulting force will move ball 1 up inclined pathway $3^a$.

It will be observed that whether the configuration of the micro- to macromotion pathway is that illustrated in FIG. 1 or FIG. 2, the force of gravity will bring ball 1 to rest in its original position, the gravitational resting point. Renewed motion will cause ball 1 to travel over the same pathway to a new position, and after the force of the motion is no longer present, gravity will again restore ball 1 to its original position. Thus, the movement of ball 1 over time is repeated and is reciprocal, i.e., it travels the same distance back and forth over the same track, always returning to its original position. Where an extremely small amount of motion is to be detected, i.e., where micromotion is involved, the repeated, reciprocal movement of ball 1 in constant contact with the pathway will be correspondingly small, and can measure a total length, i.e., back and forth, of less than 1 mm, even less than 100μ, and even less than 10μ.

The material from which the portion of the pathway being in contact with the spherical object is made, is one whose electrical resistance is between 0.8 and 10 times that of copper, where the resistance of copper is given as 1.0. This potentially includes such metals as silver (0.96), copper (1.0), nickel, gold (1.38), aluminum (1.59), tungsten (3.2), brass (4.4), platinum (5.8), iron (6.67), tin (8.2) and steel (8.62). However, from the standpoint of efficiency, cost, performance and handling, the preferred metals are copper, nickel, brass and aluminum, with copper being the most preferred material. Alloys, mixtures and composites using these metals can also be used provided their electrical properties are within the stated definition and also comport with the other requirement for satisfactory operation of the devices described herein. It is also important to achieving the desired end result, particularly as it relates to the sensitivity of the device, that the micro finish of the material from which the portion of the pathway being in contact with the spherical object is made, which is preferably copper, is No. 8 or less. This is a standard measure of the fineness of the polishing to which the metal surface in question has been subjected, and thus of the comparative dimensions of the surface irregularities involved.

The next component of the sensing portion of the device of the present invention is a terminal domain having a conformation which requires the substantially spherical object to be in constant contact therewith when at the gravitational resting point on said pathway, but which also permits the substantially spherical object to move away therefrom in response to external forces. The terminal domain is, essentially, an electrical terminal which, in cooperation with the micro- to macromotion pathway allows electrical current to pass through the substantially spherical object or ball. The conformation of the terminal domain must be such that it provides good electrical contact with the ball, while at the same time affording no restraint of any kind to movement of the ball away from the terminal domain in response to external forces. Where micromotion is being detected, the ball will remain essentially in contact with the terminal domain as well as the pathway, and the micromotion will be sensed by the changes in fluctuation of the current, as explained in more detail below. Where macromotion is involved, on the other hand, the ball will move out of contact with the terminal domain and there will be a breaking of the electrical circuit, which will also be sensed by the device of the present invention.

The portion of said terminal domain which is in contact with said spherical object is made of a material whose electrical resistance is between 0.8 and 10 times that of copper, where the resistance of copper is given as 1.0. This is the same class of materials, in terms of electrical resistance, as that from which the material is chosen to make the micro- to macromotion pathway. This is for the purpose of maintaining the significant difference in resistance profiles between the ball and its contacts with the detection circuitry. Accordingly, the choice of materials includes such metals as silver (0.96), copper (1.0), nickel, gold (1.38), aluminum (1.59), tungsten (3.2), brass (4.4), platinum (5.8), iron (6.67), tin (8.2) and steel (8.62). However, from the standpoint of efficiency, cost, performance and handling, the preferred metals are copper, nickel, brass and aluminum, with copper being the most preferred material. Alloys, mixtures and composites using these metals can also be used provided their electrical properties are within the stated definition and also comport with the other requirement for satisfactory operation of the devices described herein. Here again, it is also important to achieving the desired end result, particularly as it relates to the sensitivity of the device, that the micro finish of the material, from which the portion of the terminal domain which is in contact with the spherical object is made, which is preferably copper, is No. 8 or less. As already indicated, this is a standard measure of the fineness of the polishing to which the metal surface in question has been subjected, and thus of the comparative dimensions of the surface irregularities involved.

The material from which the portion of ball 1 in contact with the pathway is made, is required to have electrical resistance properties which are at least 1000 times those of copper, where the resistance of copper is given as 1.0. The preferred materials which fall within this definition are chromium and alloys of chromium, especially nickel chromium, and more especially wherein said nickel chromium alloy is a coating on a core of steel. As is the case with the material from which the pathway and terminal domain in contact with the spherical object or ball is made, it is important to achieving the desired end result, particularly as it relates to the sensitivity of the device, that the micro finish of the substantially spherical object or ball be No. 4 or less in order to assure a high degree of sensitivity in the device. However, it is another advantageous feature of the devices of the present invention that the degree of sensitivity thereof can be readily regulated or modulated by adjusting the microfinish of the surface of the spherical object or ball. Thus, where less sensitivity is required, the microfinish number of the spherical object or ball may be higher, e.g., No. 8.

The detecting portion of the devices of the present invention comprise a source of direct current electromotive force of about 12 volts or less, being substantially negative (−) with a positive (+) component of from about 1% to about 3% thereof. Low voltage electrical power sources are frequently used with motion detectors in the prior art for two reasons. First, many of the applications for such motion detectors are related to their use with automobiles, which are powered by 12 volt direct current systems. The second reason is that where electrical contact is being made and broken, often repeatedly within a short period of time, high voltages will permit electrical arcing to take place at the point of contact, which will eventually lead to corrosion, erosion, pitting and related deterioration at the site of contact which may eventually lead to failure of the device.

Another feature of the detection portion of the device is that the substantially spherical object is connected to the negative terminal of the source of direct current, said terminal being the ground reference in the system, while the spherical object is simultaneously in constant contact with the micro- to macromotion pathway. This is a critical feature of the present invention which clearly distinguishes it Prom the motion sensor systems of the prior art, which require that the spherical object or ball by its movement close and open electrical circuits associated therewith. It is a novel concept of the present invention to have the spherical object or ball constantly and simultaneously in contact both with the terminal domain and with the micro- to macromotion pathway, one of which is in electrical contact with the source of direct current, the other of which is in electrical contact with the detection circuitry in the remainder of the system. In both cases a complete electrical circuit is made through the spherical object or ball, and both cases are embodiments of the present invention. Consequently, the device of the present invention maintains a constant completed circuit from: the direct current source>to the micro- to macromotion pathway>to the ball /or/>to the terminal domain>to the ball and then>to the detection circuitry.

The manner in which the devices of the present invention detect motion, especially micromotion, is by fluctuations in electrical current passing through the sensing portion, induced by the slightest movements of the spherical object or ball while being in constant contact with the micro- to macromotion pathway. It is theorized that the mechanism by which this takes place and which, consequently, forms the basis for the devices of the present invention, is the unexpected and substantial variability in the resistance characteristics of different portions of the surface of the substantially spherical object component of the present devices. It has been discovered that resistance values will vary greatly from one point to an adjacent point of the ball's surface, even when the distance between them is infinitesimal. For example, if the two probes of an ohmmeter with very high sensitivity are made to contact the ball's surface at any two points, fluctuating resistance readings will be observed until there is virtually no motion between the ball and probes.

It is theorized that materials such as nichrome, having at least 1000 times the resistance of copper to the flow of a current of electrons, possess a microstructure that is nevertheless highly variable in its resistance characteristics, due to differences in the crystalline structure or lack thereof or the presence of amorphous segments therein, variability in the proportions of nickel, chromium and possible contaminants therein, variations in the thickness of the coating where one is present, and other factors which remain unknown. However, the high electrical resistance characteristic, i.e., more than 1000 times that of copper where copper is given as 1.0, typifies those materials which are suitable for use in the present invention. Consequently, it is an essential feature of the materials used to make the portion of the spherical object or ball which comes in contact with the terminal domain and the micro- to macromotion pathway. This feature, in conjunction with the low level of resistance of the materials used to fabricate the terminal domain and the micro- to macromotion pathway, allows the devices of the present invention to exploit this surprising resistance variability in order to provide a degree of sensitivity to micromotion that is unparalleled.

The detecting portion of the devices of the present invention for determining the presence of micro- to macromotion comprise, as the first component, a source of direct current electromotive force of about 12 volts or less, being substantially negative (−) with a positive (+) component of from about 1% to about 3% thereof. Where the device of the present invention is to be included as part of an anti-theft installation in an automobile, it can be powered by a battery typically present in such an automobile. Where the device of the present invention is to be used in some other environment, e.g., the home, voltage transformers can be used to step down the current to an acceptable level. These and other adaptations are well within the ordinary skill of the art to which the present invention pertains.

The substantially spherical object or ball is in electrical contact with the negative terminal of the source of direct current described above, and the terminal is the ground reference in the system. This is a conventional installation and modifications thereof in keeping with the purposes of the present invention are well within the skill or the artisan to address. The electrical contact of the ball with the negative terminal of the direct current source is either by way of the terminal domain or by way of the micro- to macromotion pathway. Thus, it makes little practical difference whether the current is flowing in one direction or the other, as has been explained further above. When the substantially spherical object or ball is at the gravitational resting point of the micro- to macromotion pathway, it will be simultaneously in electrical contact with both the pathway and with the terminal domain. This is a key configuration of the devices of the present invention which permits them to achieve very high levels of sensitivity to micromotion, since in this configuration what is being detected are fluctuations in resistivity, i.e., current, caused by infinitesimally small changes in the precise points of electrical contact between the surface of the ball and the surfaces of the terminal domain and the micro- to macromotion pathway.

Either the micro- to macromotion pathway or the terminal domain will be in electrical contact with the detection circuitry in the devices of the present invention, when the other is in electrical contact with the negative terminal of the source of direct current. As already explained, it makes little practical difference whether the current flows in one direction or the other, since the fluctuations in resistance and therefore current are what are being detected. In either case, it should be noted, a complete electrical circuit is established through the substantially spherical object or ball when it is at the gravitational resting point.

Figure 3:
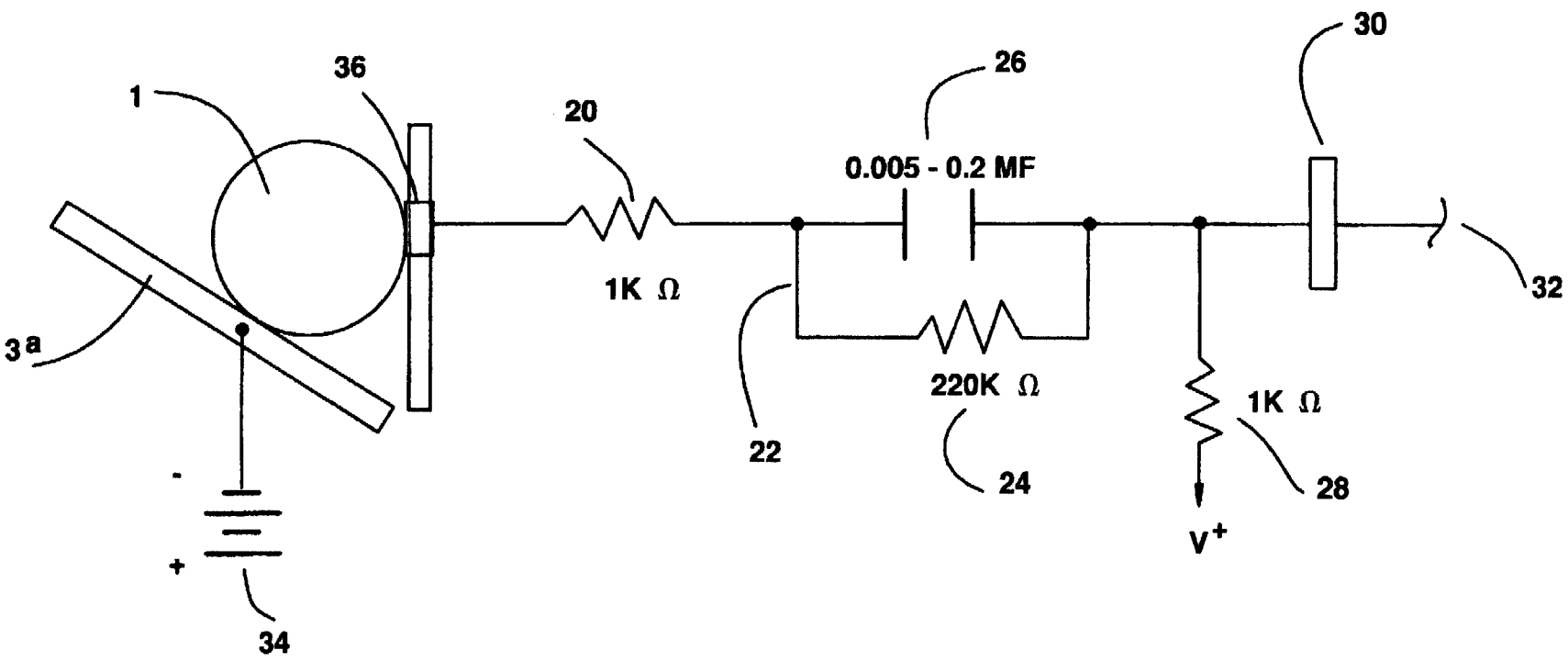
FIG. 3 is a block diagram of preferred detection circuitry for use in the devices of the present invention.

The detection circuitry associated with the micro- to macromotion sensing portion of the devices of the present invention detects fluctuations in electrical current passing through said sensing portion. In a preferred embodiment shown in FIG. 3, this detection circuitry comprises: (a) initial resistor 20 of from about 0.5K to 5K Ω; followed by (b) divided circuit 22 comprising: (1) bleeding resistor 24 having a resistance of from about 100K to 1MM Ω in one branch of the divided circuit; and (2) capacitor 26 having a capacitance of from about 0.005 to 0.2 μF in the other branch of divided circuit 22; said divided circuit being rejoined and followed by (c) resistor 28 of from about 0.5K to 5K Ω; and (d) transistor 30 that when activated will provide sufficient current to operate warning portion 32 of the device. Other portions of the device of the present invention which are illustrated are direct current source 34 in electrical contact with micro- to macromotion pathway $3^a$ and substantially spherical object 1, and in turn terminal domain 36.

The initial resistor, which preferably has a resistance of about 1K Ω, will determine the timing of the detection circuitry, with 1K Ω establishing a circuit time of about 100 μsec. This very short duration is necessary to insure that the flow of electrons over the various surfaces of the device are kept to a minimum so as to prevent or at least retard the erosion and deterioration of those surfaces by the processes involved in electrical arcing. The divided or parallel circuit has a very high value or "bleeding" resistor in one branch with from 100K to 1MM Ω of resistance so that low current values of about 1 V will activate the transistor. The transistor, once activated supplies current to the warning portion of the device of the present invention.

The final portion of the devices of the present invention is the warning portion for alerting a user of the device, another person, or both, that a micro- to macromotion has been sensed and detected. This warning portion comprises means for translating electrical current from the detecting portion into a signal which provides useful information to the user, another person, or both. Thus, this portion might also be referred to as the "informing portion", since it communicates information to the user whether or not it is in such form as to constitute a warning. Well known means can be employed to convert the electrical current into another form of energy which the senses of the user, other person, or both, are able to detect. For example, the form of energy may be sound waves that the user, other person, or both, would perceive and recognize as a horn, whistle, bell or siren. The form of energy may additionally or alternatively be light waves that the user, other person, or both, would perceive and recognize as a glowing light, flashing light, or progressive display of lights, whether mono- or polychromatic or both. Combinations of such other forms of energy are contemplated.

In a preferred embodiment of the present invention, the warning portion is used to solve a long-standing problem involving the use of ABS, i.e., automated braking systems, which rely on extremely rapid sensory input from the brakes to a computer with corresponding output comprising pulsed braking adjustments among the wheels of the motor vehicle. Such systems prevent or avoid "locking" of the wheels of the motor vehicle, thereby eliminating the readily audible sound of "squealing tires" so commonly associated with hard, rapid braking. There is also thereby eliminated, consequently, the attendant warning sounds which would otherwise be given to drivers of nearby motor vehicles, as well as nearby pedestrians, that such hard, rapid braking is taking place. This warning sound is frequently, if not invariably, of critical importance to the safety of those other drivers and pedestrians. In a preferred embodiment of the present invention, the electrical current from the detecting portion of the device is converted or transformed into an audible signal comprising sound waves which are capable of being perceived and recognized by drivers of nearby motor vehicles and nearby pedestrians as the "squealing tires" of a motor vehicle which is being subjected to hard, rapid braking and which is not equipped with an ABS braking system. This audible signal may be combined with a visible signal, e.g., a flashing light, which supplements the continuous light being emitted by the brake lights on the motor vehicle.

What is claimed is:

1. A micro- to macromotion sensing, detecting and warning device comprising:

(A) a micro- to macromotion sensing portion of said device comprising:

(1) a micro- to macromotion pathway having a conformation which permits repeated, reciprocal movement from or about a gravitational resting point thereon of a substantially spherical object in constant contact therewith and free to move thereon in response to external forces, a portion of said pathway which is in contact with said spherical object being made of a material whose electrical resistance is between 0.8 and 10 times that of copper, where the resistance of copper is given as 1.0;

(2) a terminal domain having a conformation which requires said substantially spherical object to be in constant contact therewith when at said resting point on said pathway, but which also permits said substantially spherical object to move away therefrom in response to said external forces, a portion of said terminal domain which is in contact with said spherical object being made of a material whose electrical resistance is between 0.8 and 10 times that of copper, where the resistance of copper is given as 1.0; and (3) a substantially spherical object disposed for repeated, reciprocal movement from or about said gravitational resting point on said micro- to macromotion pathway and in constant contact therewith, the portion of said spherical object being in contact with said pathway being made of a material whose electrical resistance is at least 1000 times that of copper, where the resistance of copper is given as 1.0;

(B) a detecting portion of said device for determining the presence of said micro- to macromotion comprising:

(1) a source of direct current electromotive force of about 12 volts or less, being substantially negative (−) with a positive (+) component of from about 1% to about 3% thereof;

(2) said substantially spherical object being in electrical contact with the negative terminal of said source of direct current, said terminal being the ground reference in the system, by way of said terminal domain or by way of said micro- to macromotion pathway, such that when said substantially spherical object is at said gravitational resting point of said micro- to macromotion pathway, it is simultaneously in electrical contact with said pathway and with said terminal domain;

(3) said micro- to macromotion pathway or said terminal domain being in electrical contact with detection circuitry as defined herein, when the other is in electrical contact with said negative terminal of said source of direct current, thereby forming a complete electrical circuit through said substantially spherical object when at said gravitational resting point; and (4) detection circuitry associated with said micro- to macromotion sensing portion which detects fluctuations in electrical current passing through said sensing portion, and which activates a warning portion of said device as defined herein when a predetermined change in said electrical current takes place; and (C) a warning portion of said device for alerting a user of said device, another person, or both, that a micro- to macromotion has been sensed and detected, comprising:

means for translating electrical current from said detecting portion into a signal which provides useful information to said user of said device, another person, or both.

2. A device according to claim 1 wherein said conformation of said micro- to macromotion pathway is substantially flat with respect to constant contact travel of said spherical object thereon.

3. A device according to claim 2 wherein said pathway comprises approximately half of a transverse section of a cylinder cut parallel to the axis thereof and said spherical object travels perpendicular to said axis.

4. A device according to claim 1 wherein said conformation of said micro- to macromotion pathway is substantially curved with respect to constant contact travel of said spherical object thereon.

5. A device according to claim 4 wherein said pathway comprises approximately half of a transverse section of a cylinder cut parallel to the axis thereof and said spherical object travels parallel to said axis; and wherein said pathway is maintained at an angle to the plane of the earth's surface.

6. A device according to claim 1 wherein said material from which said portion of said pathway or said terminal domain being in contact with said spherical object is made, is copper, brass or aluminum; and the micro finish of said material is No. 8 or less.

7. A device according to claim 1 wherein said repeated, reciprocal movement of said substantially spherical object in constant contact with said pathway measures a total length of less than 100μ.

8. A device according to claim 1 wherein said repeated, reciprocal movement of said substantially spherical object in constant contact with said pathway measures a total length of less than 10μ.

9. A device according to claim 1 wherein said material from which said portion of said spherical object in contact with said pathway is made, is chromium or an alloy of chromium.

10. A device according to claim 9 wherein said alloy of chromium is nickel chromium.

11. A device according to claim 10 wherein said nickel chromium alloy is a coating on a core of steel; and the micro finish of said spherical object is No. 4 or less.

12. A device according to claim 1 wherein said source of direct current electromotive force is about 12 volts, being from about 11.5 to 11.9 volts negative (−) and about 0.5 to 0.1 volts positive (+).

13. A device according to claim 1 wherein said substantially spherical object is connected to ground by electrical contact directly through said micro- to macromotion pathway by means of a portion of said detection circuitry attached to said pathway, or wherein said substantially spherical object is connected to ground by electrical contact with said terminal domain where said terminal domain is a section of copper wire laterally disposed toward said spherical object.

14. A device according to claim 1 wherein said detection circuitry associated with said micro- to macromotion sensing portion which detects fluctuations in electrical current passing through said sensing portion, comprises:

(A) an initial resistor of from about 0.5K to 5K Ω; followed by (B) a divided circuit comprising:

(1) a bleeding resistor having a resistance of from about 100K to 1MM Ω in one branch of said divided circuit; and (2) a capacitor having a capacitance of from about 0.005 to 0.2 μF in the other branch of said divided circuit; said divided circuit being rejoined and followed by (C) a resistor of from about 0.5K to 5K Ω; and (D) a transistor that when activated will provide sufficient current to operate said warning portion of said device.

15. A device according to claim 1 wherein with regard to said warning portion of said device, said signal which provides useful information to said user, another person, or both, is a signal which is audible or visible, or both, to said user of said device, another person, or both, or which is an electronic signal for inputing data to a computer or other electronic device.

16. A device according to claim 1 wherein said means for translating electrical current comprises means to convert said electrical current into another form of energy which the senses of said user, another person, or both, are able to detect.

17. A device according to claim 16 wherein said form of energy is sound waves which said user, other person, or both, would perceive and recognize as a horn, whistle, bell or siren; and/or said form of energy is light waves which said user, other person, or both, would perceive and recognize as a glowing light, flashing light, or progressive display of lights, said light being mono- or polychromatic.

18. A device according to claim 1 wherein said device including said warning portion thereof is used in association with a motor vehicle having an automated braking system (ABS) which prevents locking of wheels of said vehicle during hard, rapid braking; and wherein said electrical current from said detecting portion of said device is converted or transformed into an audible signal comprising sound waves which are capable of being perceived and recognized by drivers of nearby motor vehicles and nearby pedestrians as that of squealing tires of a motor vehicle which is not equipped with an ABS braking system being subjected to hard, rapid braking.

19. A device according to claim 18 wherein said audible signal is combined with a visible signal.

20. A device according to claim 19 wherein said visible signal is a flashing light which supplements continuous light being emitted by brake lights on said vehicle.

* * * * *